US011851986B2

(12) United States Patent
Sargent et al.

(10) Patent No.: US 11,851,986 B2
(45) Date of Patent: Dec. 26, 2023

(54) SLEEVE VALVE

(71) Applicant: TORSCH INC., Calgary (CA)

(72) Inventors: Shane Sargent, Calgary (CA); Matthew McCarthy, Calgary (CA); Sean Borschneck, Calgary (CA)

( * ) Notice: Subject to any disclaimer, the term of this patent is extended or adjusted under 35 U.S.C. 154(b) by 0 days.

(21) Appl. No.: 17/296,245

(22) PCT Filed: Nov. 25, 2019

(86) PCT No.: PCT/CA2019/051682
§ 371 (c)(1),
(2) Date: May 23, 2021

(87) PCT Pub. No.: WO2020/102913
PCT Pub. Date: May 28, 2020

(65) Prior Publication Data

US 2022/0018216 A1 Jan. 20, 2022

Related U.S. Application Data

(60) Provisional application No. 62/770,914, filed on Nov. 23, 2018.

(51) Int. Cl.

| | |
|---|---|
| ***E21B 34/14*** | (2006.01) |
| ***E21B 41/00*** | (2006.01) |
| ***E21B 43/12*** | (2006.01) |

(52) U.S. Cl.
CPC ..... *E21B 34/14* (2013.01); *E21B 41/0078* (2013.01); *E21B 43/12* (2013.01); *E21B 2200/06* (2020.05)

(58) Field of Classification Search
CPC ..... E21B 34/14; E21B 41/0078; E21B 43/12; E21B 2200/06
See application file for complete search history.

(56) References Cited

U.S. PATENT DOCUMENTS

| | | | | |
|---|---|---|---|---|
| 5,957,208 | A * | 9/1999 | Schnatzmeyer | E21B 34/06 166/334.4 |
| 5,979,558 | A * | 11/1999 | Bouldin | E21B 34/14 166/334.4 |
| 2007/0204995 | A1 * | 9/2007 | Hofman | E21B 43/26 166/308.1 |

(Continued)

FOREIGN PATENT DOCUMENTS

| | | |
|---|---|---|
| EA | 030278 | 7/2018 |
| RU | 2316643 | 6/2007 |
| RU | 2320859 | 3/2008 |

*Primary Examiner* — James G Sayre
(74) *Attorney, Agent, or Firm* — Richard D. Okimaw

(57) ABSTRACT

An apparatus for selectably injecting materials into a well comprises an elongate inner casing having first and second sets of selectably closable passages therethrough and an outer casing extending between the first and second ends surrounding the inner casing so as to form an annular cavity therebetween. The first end of the outer casing is sealably connected to the inner casing and the second end of the outer casing has a free edge proximate to the second set of passages. The first set of passages extends through the inner casing into the annular cavity such that fluid passing through either of the first or second sets of passages enters an exterior of the apparatus at a common location.

20 Claims, 7 Drawing Sheets

(56) References Cited

U.S. PATENT DOCUMENTS

| | | | | |
|---|---|---|---|---|
| 2008/0314590 | A1* | 12/2008 | Patel | E21B 34/06 166/227 |
| 2009/0014185 | A1 | 1/2009 | Franco et al. | |
| 2015/0013198 | A1 | 1/2015 | R. S et al. | |
| 2016/0312579 | A1 | 10/2016 | Green et al. | |
| 2017/0159406 | A1 | 6/2017 | Flores Perez | |
| 2018/0030812 | A1* | 2/2018 | Ning | E21B 43/16 |

* cited by examiner

SLEEVE VALVE

BACKGROUND OF THE INVENTION

1. Field of Invention

The present invention relates to hydrocarbon well control in general and in particular methods and apparatuses for selectably opening and closing zones within a hydrocarbon well during completion, hydraulic fracturing or production.

2. Description of Related Art

In hydrocarbon production, it has become common to utilize directional or horizontal drilling to reach petroleum containing rocks, or formations, that are either at a horizontal distance from the drilling location. Horizontal drilling is also commonly utilized to extend the wellbore along a horizontal or inclined formation or to span across multiple formations with a single wellbore.

In horizontal hydrocarbon wells, it is frequently desirable to select which zone of the wellbore is to be opened for production or to stimulate one or more zones of the well to increase production of that zone time to time. One current method of stimulating a portion of the well is through the use of hydraulic fracturing or fracing. One difficulty with conventional fracing systems is that it is necessary to isolate the zone to be stimulated on both the upper and lower ends thereof so as to limit the stimulation to the desired zone. Such isolation has typically been accomplished with sealing elements known as production packers located to either side of the zone to be isolated. Production packers must be removed in order to access zones beyond the packers within the well.

In addition to fracing, it is desirable to stimulate production in hydrocarbon wells by injecting fluid into the oil field in order to increase pressure within the production zone. Additionally, it is desirable to allow a variety of injection profiles, or flow rates, across numerous zones within the wellbore to optimize production throughout the well. This stimulation may be desirable at any time during the life of the well. It will be appreciated that such stimulation or other operations within the well may require the use of different flow rates Sleeve valves have been developed to eliminate the requirement of the production packers, as described in US Patent Application Publication No. 2014/0174746 A1 to George et. al. While the use of such sleeve valves eliminates the necessity of production packers, they do not permit a variety of injection profiles.

SUMMARY OF THE INVENTION

According to a first embodiment of the present invention there is disclosed an apparatus for selectably injecting materials into a well comprising an elongate inner casing having first and second sleeve valves therethrough and an outer casing surrounding the inner casing and extending between the first and second sleeve valves so as to define a common cavity therebetween extending between the first and second sleeve valves. The apparatus further comprises at least one ridge extending from an inner annular surface of the inner casing between the first and second sleeve valve operable to be engaged upon by a shifting tool moving between the first and second sleeve valves in an engaged position.

The apparatus may further comprise at least one nozzle located within the cavity so as to separate first and second portions proximate to the first and second portions thereof. The at least one nozzle may comprise a plurality of nozzles. The nozzles may be located within a nozzle body. The nozzle body may be secured within an annular wall extending between the inner and outer casings within the cavity. The nozzles may be threadably inserted within ports in the annular wall.

The ridges may extend around a periphery of the interior casing. The at least one ridge may comprise two ridges. The two ridges may be spaced along a length of the interior casing. The ridges may have a substantially transvers surface facing its corresponding sleeve valve and an angularly disposed surface on a rear thereof.

The cavity may be substantially annular. The cavity may include a first portion proximate to the first sleeve and a second portion proximate to the second sleeve. The cavity may include an exit port within the second portion.

According to a further embodiment of the present invention there is disclosed an apparatus for selectably injecting materials into a well comprising an elongate inner casing having first and second sets of selectably closable passages therethrough and an outer casing extending between the first and second ends surrounding the inner casing so as to form an annular cavity therebetween. The first end of the outer casing is sealably connected to the inner casing and the second end of the outer casing has a free edge proximate to the second set of passages. The first set of passages extends through the inner casing into the annular cavity such that fluid passing through either of the first or second sets of passages enters an exterior of the apparatus at a common location.

The first and second passages may provide first and second paths from the interior of the inner casing to an exterior of the apparatus. The first and second paths may have different flow rates therethrough. The first path may have a lower flow rate than the second path.

The first path may include at least one nozzle therein selected to reduce the flow rate through the second path to a desired rate. The at least one nozzle may be located within the annular cavity. The at least one nozzle may be located with the first set of passages. The at least one nozzle may comprise a plurality of nozzles. The nozzles may be located within a nozzle body. The nozzle body may be secured within an annular wall extending between the inner and outer casings within the cavity. The nozzles may be threadably inserted within ports in the annular wall.

The first and second ports may be selectably open and closable by a sleeve longitudinally moveable within the interior of the casing to selectably cover or uncover the first and second ports. The interior casing may include an enlarged portion around the second set of passages so as to radially support the second end of the outer casing. The enlarged portion may include a plurality of longitudinal slots formed into an exterior surface thereof. The radial slots may be spaced at locations corresponding to each passage of the second set of passages. The radial slots may extend into and are in fluidic communication with the annular passage. The apparatus may further comprise a frangible band secured around the enlarged portion so as to cover the second set of passages and the slots in an initial position.

According to a further embodiment of the present invention there is disclosed a method of selectably injecting materials into a well comprising securing an elongate inner casing having first and second sets of selectably closable passages therethrough with a corresponding outer casing surrounding the inner casing so as to form an annular cavity therebetween to a wellbore string, positioning the inner casing at a desired position within the wellbore and selectably opening or closing one of the first or second passages to provide a first or second path from an interior of the inner casing to an exterior of the inner and outer casings wherein the first extends through the annular cavity and the second path extends through the second set of passages and wherein the first and second passages terminate at a common location.

The method may further comprise rupturing a frangible band covering a termination of the first and second paths when either of the first or second sets of passages is opened to flow of fluid from within the interior of the casing. The method further comprise providing at least one nozzle to throttle a flow rate through the first path.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
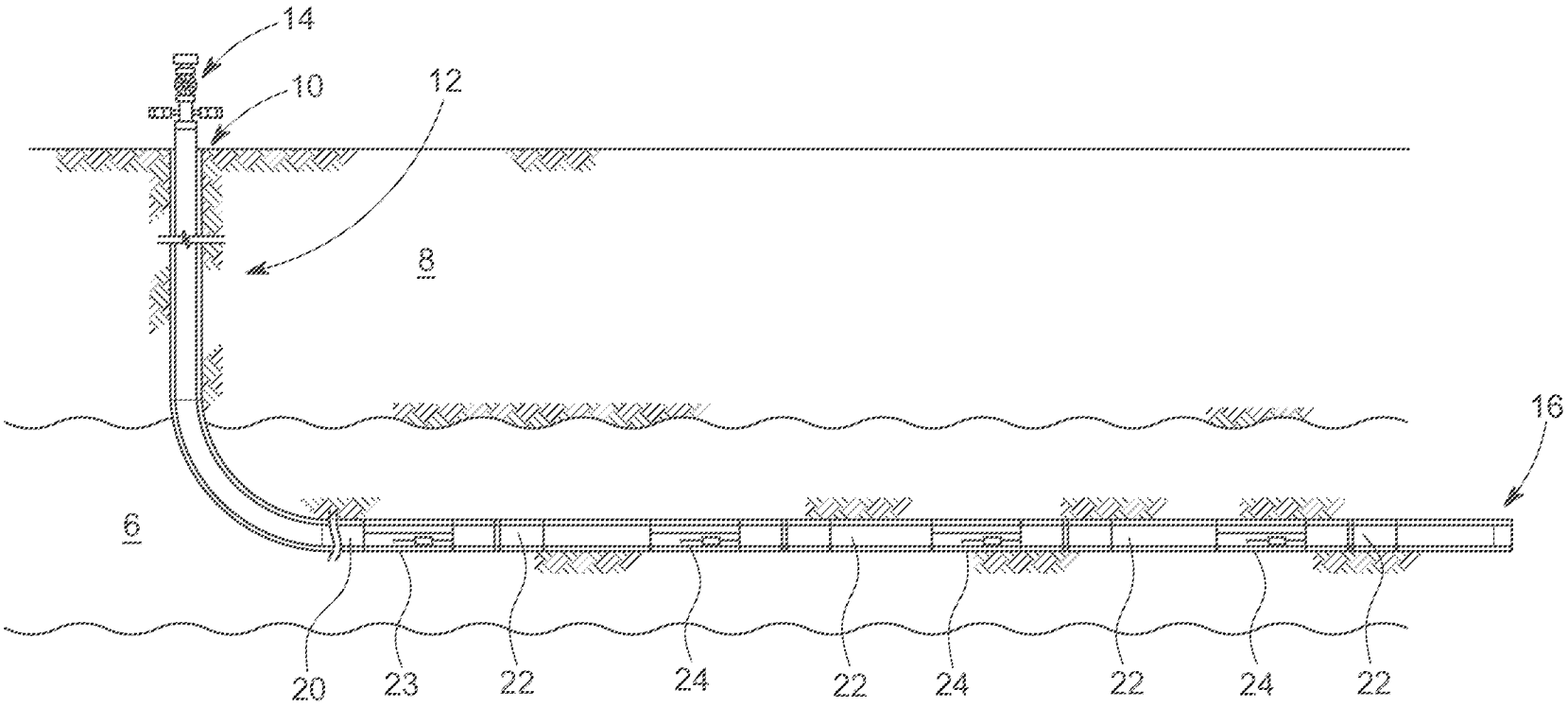
FIG. 1 is a cross-sectional view of a wellbore having a plurality of sleeve valves according to the first embodiment of the invention.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the production tubing 20 is of the hydrocarbon well is formed of a plurality of alternating liner or casing 22 sections and in line valve bodies 24 surrounded by a layer of cement 23 between the casing and the wellbore. The valve bodies 24 are adapted to control fluid flow from the surrounding formation proximate to that valve body and may be located at predetermined locations to correspond to a desired production zone within the wellbore. In operation, between 8 and 100 valve bodies may be utilized within a wellbore although it will be appreciated that other quantities may be useful as well.

Figure 2:
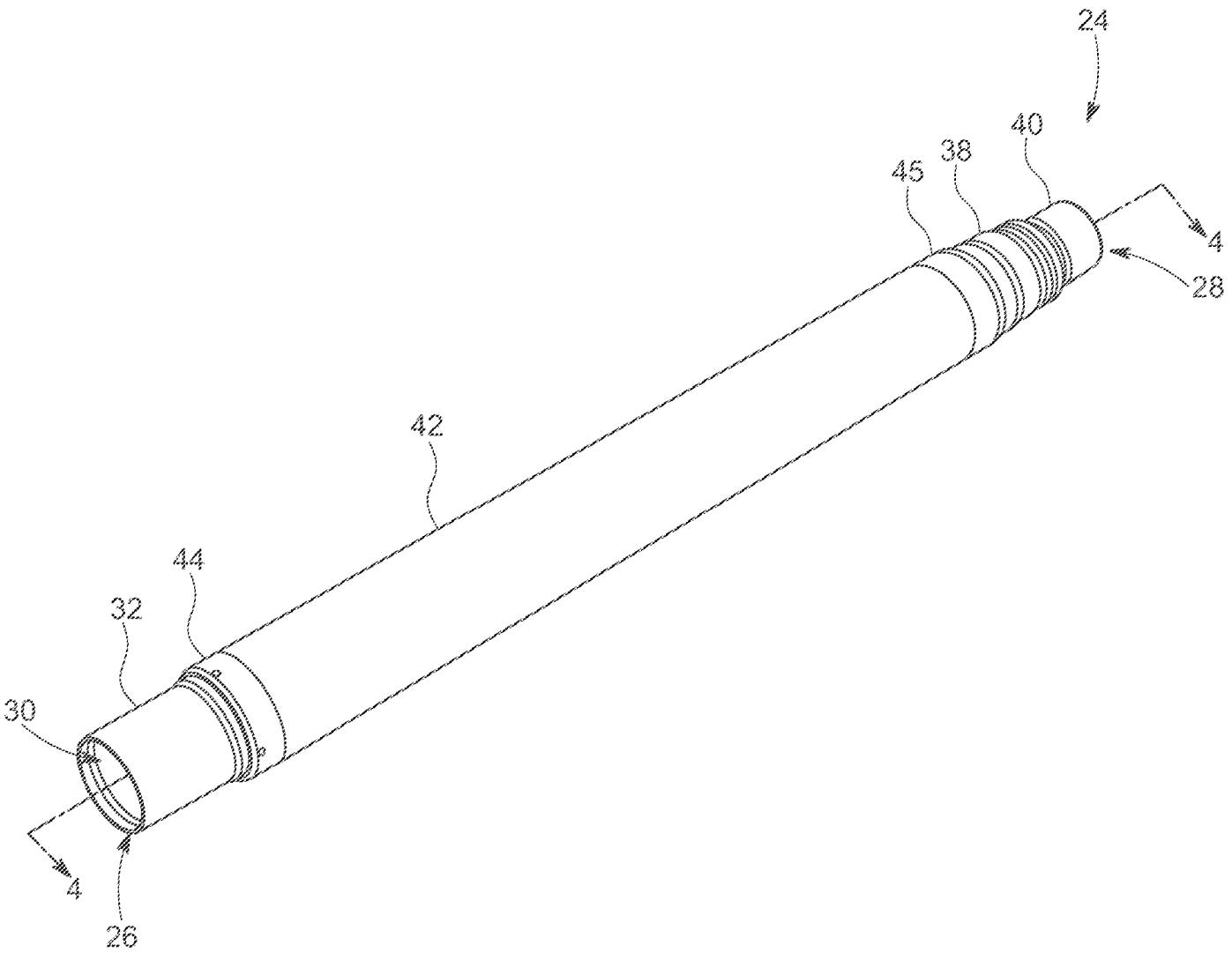
FIG. 2 is a perspective view of one of the sleeve valves of FIG. 1.

Turning now to FIG. 2, a perspective view of one valve body 24 is illustrated. The substantially elongate cylindrical valve body 24 extends between first and second ends 26 and 28, respectively, having a central passage 30 therethrough. The first end 26 of the valve body is connected to adjacent liner or casing section 22 with an internal threading in the first end 26. The second end 28 of the valve body is connected to an adjacent casing section with external threading around the second end 28.

Figure 3:
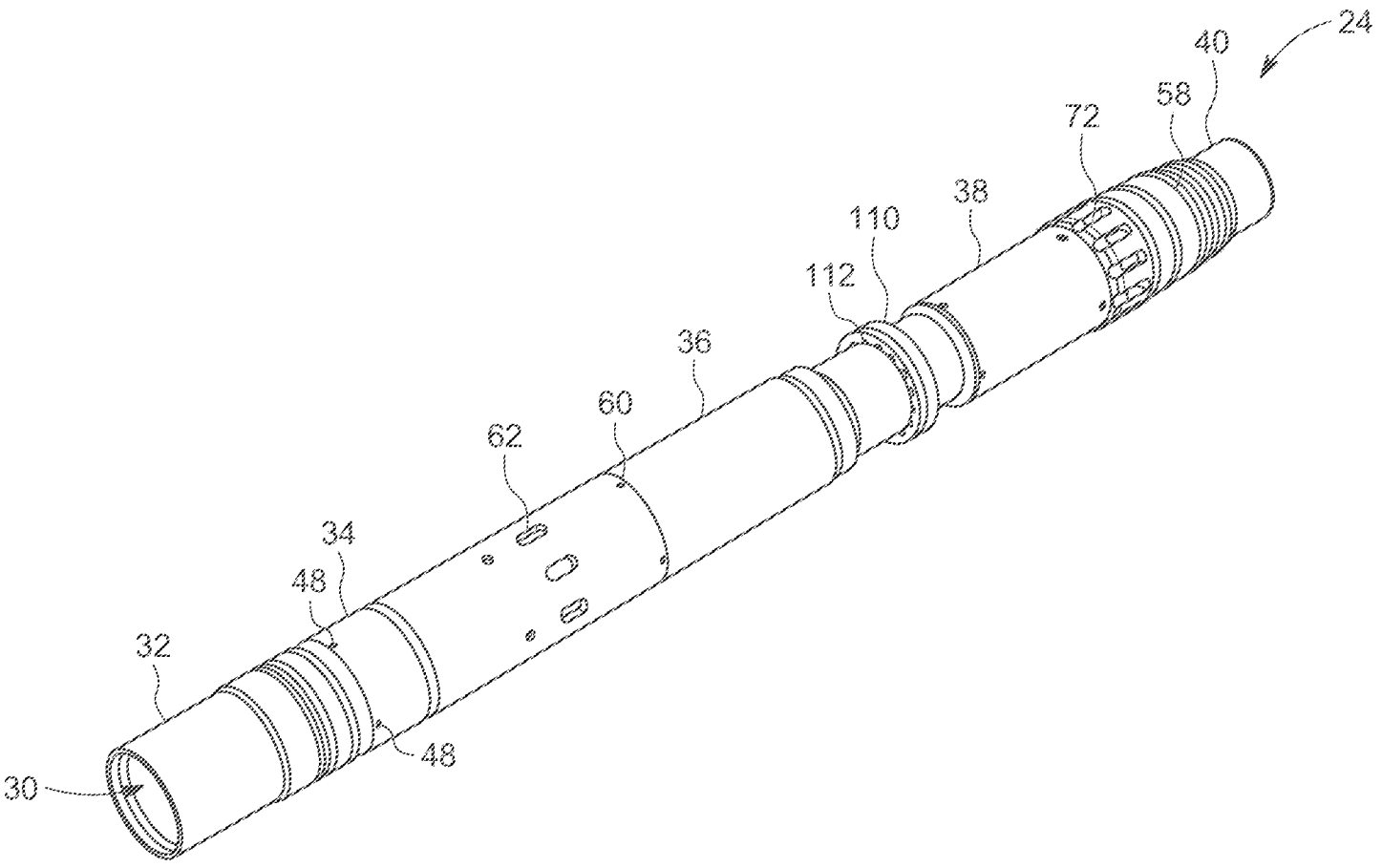
FIG. 3 is a perspective view of the sleeve valve of FIG. 2 with the outer casing removed.
Figure 4:
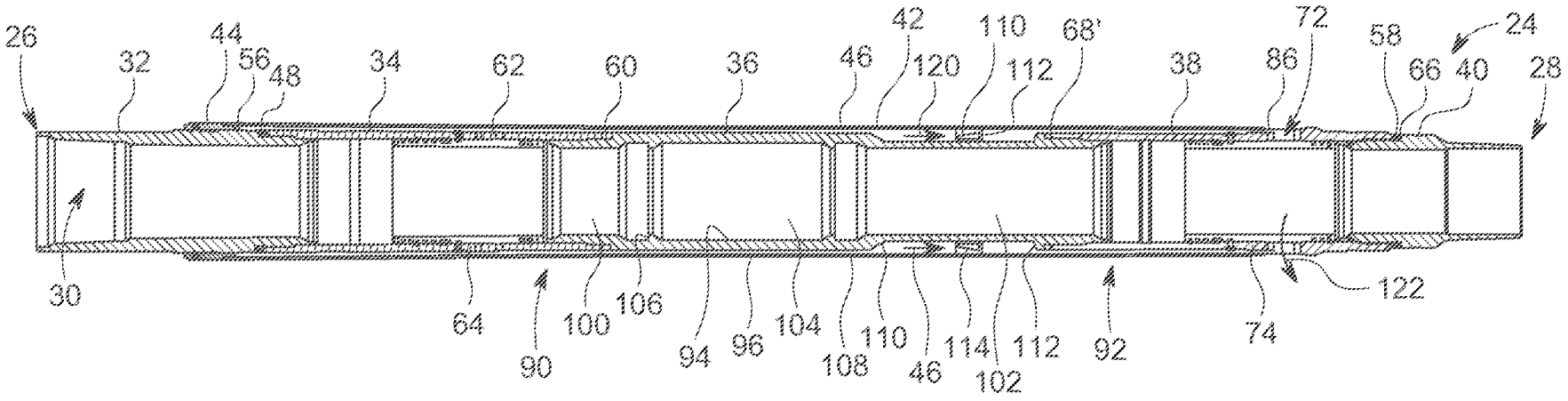
FIG. 4 is a longitudinal cross-sectional view of the sleeve valve of FIG. 2 taken along the line 4-4 in the first retracted position with the first and second end sleeves closed.

Turning to FIGS. 3 and 4, the valve body 24, extending between first and second ends 26 and 28, respectively, is sequentially comprised of a first end connector 32 proximate to the first end 26, a first end valve body 34, a port injection sleeve 36, a second end valve body 38, and a second end connector 40 proximate to the second end 28. As best seen on FIGS. 2 and 4, a portion of the first end connector 32, the first end valve body 34, the port injection sleeve 36 and a portion of the second end valve body 38 are substantially enclosed within an outer casing 42, capped by a first end retaining sleeve 44, and forming an annular cavity 46 therebetween. As shown on FIG. 2, a second end retaining sleeve 45 covers a portion of the second end valve body 38. As illustrated in FIG. 4, the first and second end valve bodies form part of and provide first and second flow paths 120 and 122, respectively for fluid to pass from the central passage 30 to the exterior of the valve body, the purpose of which will be more fully described below.

Figure 7:
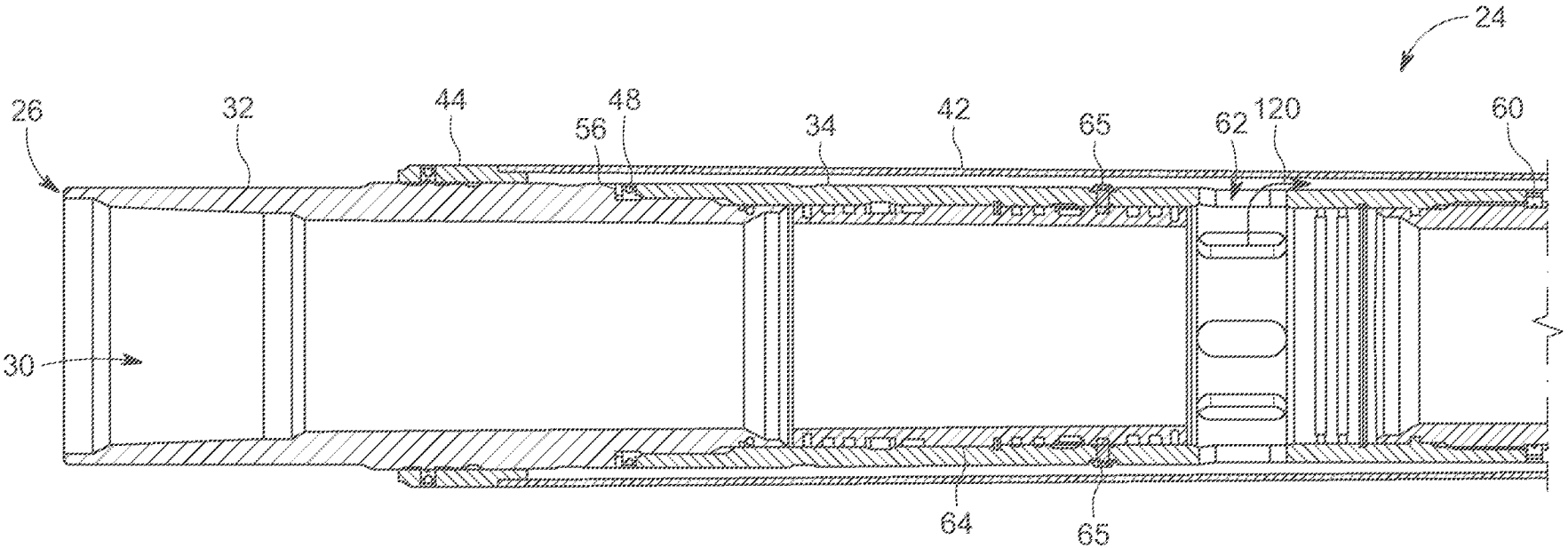
FIG. 7 is a longitudinal cross-sectional view of the first end of the sleeve valve of FIG. 2 taken along the line 4-4 in the third extended position with the first end sleeve open.

As seen on FIGS. 4 and 7, the first end connector 32 is connected to an adjacent liner or casing section 22 with internal threading in the first end 26. The second end of the first end connector 32 is connected to the first end valve body 34 with a plurality of set screws 48 radially therearound, although it may be appreciated that other connection methods may be useful, as well. The first end of the first end valve body 34 abuts an annular shoulder 56 on the exterior of the first end connector 32, with the second end of the first end connector 32 sized to fit within the first end of the first end valve body 34.

Figure 6:
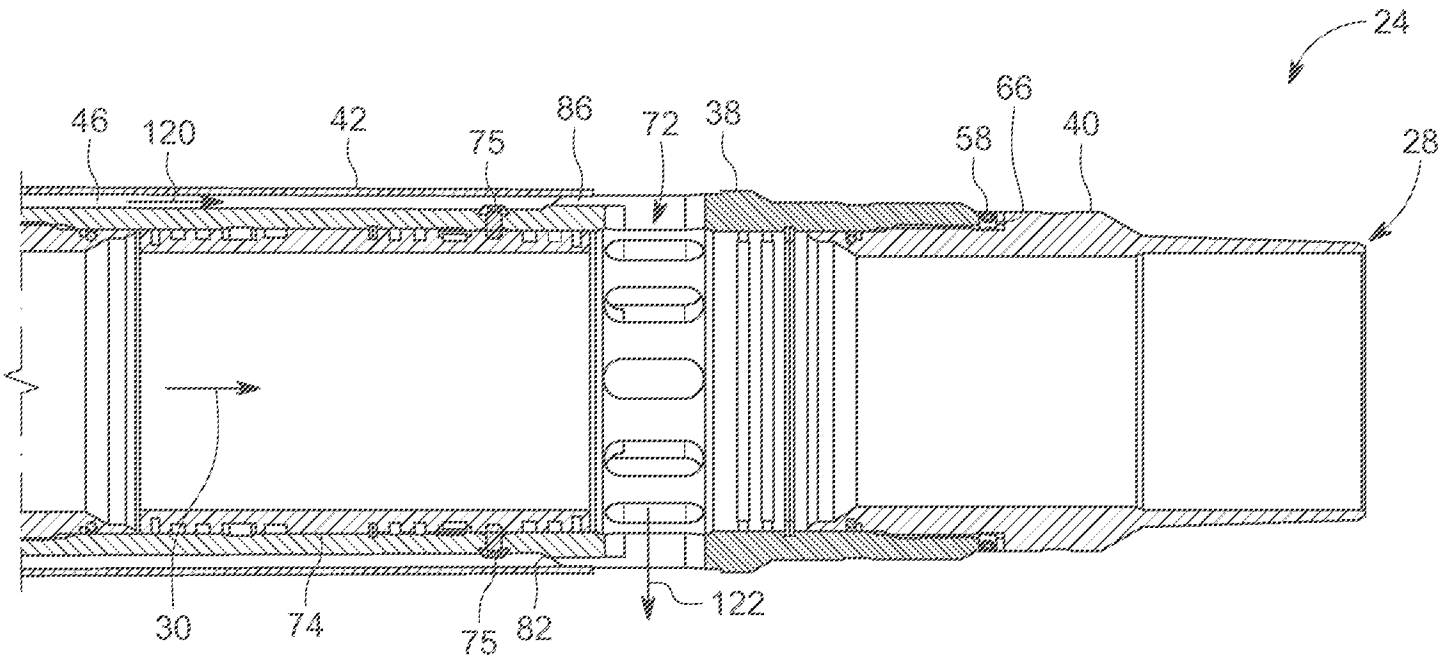
FIG. 6 is a longitudinal cross-sectional view of the second end of the sleeve valve of FIG. 2 taken along the line 4-4 in the second extended position with the second end sleeve open.

As seen on FIGS. 4 and 6, the second end connector 40 is connected to an adjacent liner or casing section 22 with external threading around the second end 28. The first end of the second end connector 40 is connected to the second end valve body 38 with a plurality of set screws 58 radially therearound, although it may be appreciated that other connection methods may be useful, as well. The second end of the second end valve body 38 abuts an annular shoulder 66 on the exterior of the second end connector 40, with the first end of the second end connector 40 sized to fit within the second end of the second end valve body 38.

The first end valve body 34, as seen in FIGS. 3, 4 and 7, may be essentially the same external diameter throughout its entire length. Set screws 48 pass radially therethrough at the first end to connect with the second end of the first end connector 32, as described above. A plurality of set screws 60 connect the second end of the first end valve body 34 to the first end of the port injection sleeve 36 radially therearound, although it may be appreciated that other connection methods may be useful, as well. A plurality of apertures 62 extend from the exterior to the interior of the first end valve body 34. The apertures 62 are sized to provide a fluid passage between the central passage 30 of the interior of the first end valve body 34 and the annular cavity 46 between the exterior of the first end valve body 34 and the outer casing 42.

FIGS. 4 and 7 illustrate a cross-sectional view of the first end valve body 34 in the first retracted position and the third extended position, respectively. The central passage 30 of the first end valve body 34 is substantially cylindrical and contains a first end sliding sleeve 64 therein, releasably secured to the first end valve body 34 with shear pins 65, as are commonly known. The first end sliding sleeve 64 is longitudinally displaceable therein, upon shearing the shear pins 65. In the first retracted position, as shown in FIG. 4, the first end sliding sleeve 64 sealably covers the apertures 62 so as to isolate the interior from the exterior of the first end valve body 34. In the third extended position, as shown in FIG. 7, the first end sliding sleeve 64 exposes the apertures 62, thereby fluidically connecting the central passage 30 and the annular cavity 46, as will be described in more detail below. The shear pins 65 are sheared and the first end sliding sleeve 64 is displaced with the use of a shifting tool (not shown), as are commonly known.

The second end valve body 38, as seen in FIGS. 3, 4 5 and 6, includes a central portion 70 which is raised on the exterior therearound, as will be described in more detail below. Set screws 58 pass radially therethrough at the second end to connect with the first end of the second end connector 40, as described above. A plurality of set screws 68 connect the first end of the second end valve body 38 to the second end of the port injection sleeve 36 radially therearound, although it may be appreciated that other connection methods may be useful, as well. A plurality of apertures 72 extend from the exterior to the interior of the second end valve body 38. The apertures 72 are sized to provide a fluid passage between the central passage 30 of the interior of the second end valve body 38 and the production section 16. The exterior profile of the apertures 72 are tapered to provide a fluid passage between the annular cavity 46 and the production section 16, as will be described in more detail below.

FIGS. 4 and 6 illustrate a cross-sectional view of the second end valve body 38 in the first retracted position and the second extended position, respectively. The central passage 30 of the second end valve body 38 is substantially cylindrical and contains a second end sliding sleeve 74 therein, releasably secured to the second end valve body 38 with shear pins 75, as are commonly known. The second end sliding sleeve 74 is longitudinally displaceable therein, upon shearing the shear pins 75. In the first retracted position, as shown in FIG. 4, the second end sliding sleeve 74 sealably covers the apertures 72 so as to isolate the interior from the exterior of the second end valve body 38. In the second extended position, as shown in FIG. 6, the second end sliding sleeve 74 exposes the apertures 72, thereby fluidically connecting the central passage 30 and the production section 16, as will be described in more detail below. The shear pins 75 are sheared and the second end sliding sleeve 74 are displaced with the use of a shifting tool (not shown), as are commonly known.

Figure 5:
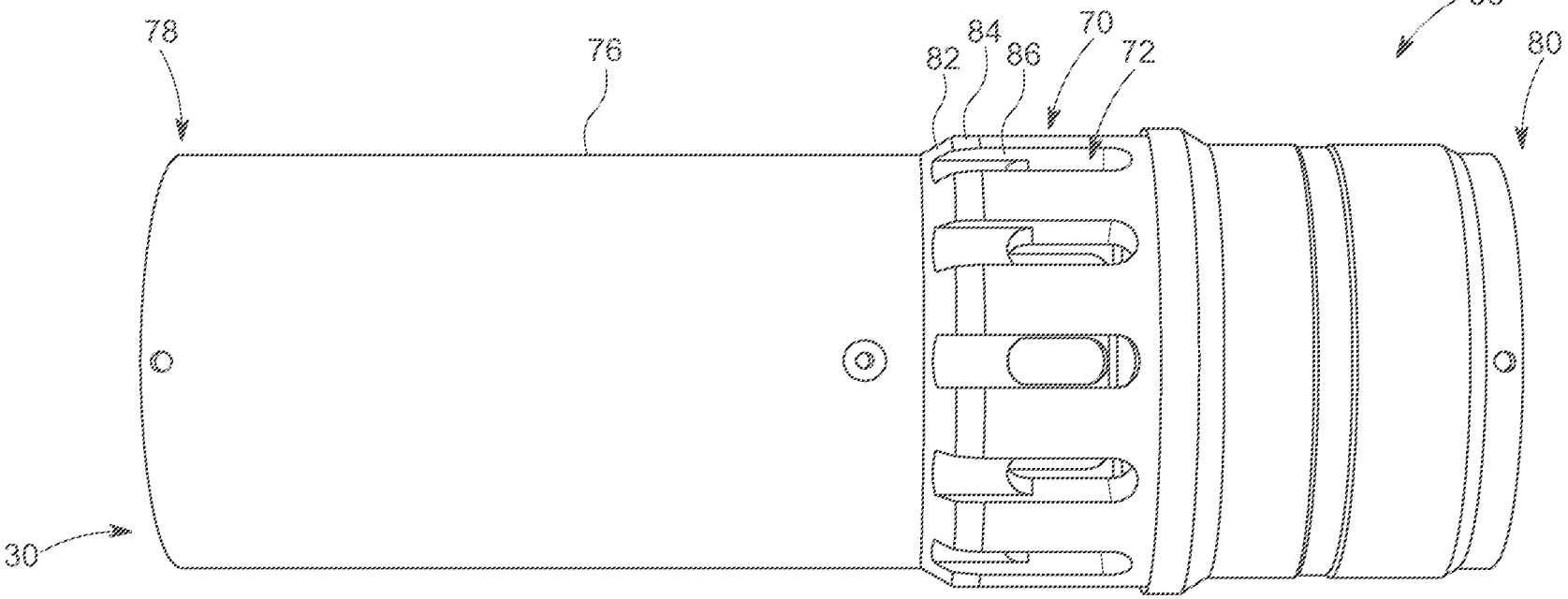
FIG. 5 is a side view of the second end valve body of the sleeve valve of FIG. 3.

Turning now to FIG. 5, the second end valve body 38 comprises a substantially elongate cylindrical outer casing 76 extending between first and second ends 78 and 80, respectively, and having a central passage 30 therethrough. The first end 78 connects to the port injection sleeve 36 as described above, and the second end 80 connects to the second end connector 40, as described above. The second end valve body 38 includes a central portion 70 which is raised on the exterior therearound. The central portion 70 includes a first tapered external shoulder 82, a second tapered portion 84. A plurality of slots 86 are milled through the raised portion as shown, connecting to apertures 72, extending from the exterior to the interior of the second valve body 38. As best seen in FIGS. 4 and 6, the outer casing 42 is sized such that the inner diameter fits onto the outer diameter of the raised central portion 70 at the second tapered portion 84. An annular cavity 46 is formed therebetween, with the fluidic connection between the annular cavity 46 and the production section 16 through the plurality of slots 86.

Turning to FIG. 4, a cross sectional view of the port injection sleeve 36 is illustrated. The port injection sleeve 36, is substantially cylindrical and having interior and exterior surfaces 94 and 96, respectively, extending between first and second ends 90 and 92 respectively, and having a central passage 30 therethrough. The first end 90 connects with the first end valve body 34, as described above, and the second end 92 connects with the second end valve body 38, as described above. The interior of the port injection sleeve 36 is comprised of entrance and exit portions, 100 and 102, respectively, with a central portion 104 therebetween. The inner diameters of the entrance and exit portions 100 and 102 are sized equivalently, with the inner diameter of the central portion being larger, to accommodate the use of the shifting key (not shown), as is commonly known. Annular ridges 106 and 108 define the first and second ends of the central portion 104, and are sized to accommodate the use of the shifting key. The ridges 106 and 108 may be substantially transverse or other orientation as necessary.

FIGS. 3 and 4 illustrate the exterior surface 96 of the port injection sleeve 36. The external diameter of the port injection sleeve 36 is substantially equivalent to the external diameter of the first and second end valve bodies 34 and 38, and less than the internal diameter of the outer casing 42 to define the annular cavity 46 therebetween. On the exterior of the port injection sleeve 36 there is defined an annularly extending wall 110 with an external diameter substantially equivalent to the internal diameter of the outer casing 42 such that fluid may not pass between the wall 110 and the outer casing 42. A plurality of nozzle passages 112 extend axially through the wall 110, such that the fluid within annular cavity 46 may pass therethrough. Each nozzle passage 112 is fitted with a nozzle 114 which is sized and adjusted to the desired injection flow rate. Although the nozzles 114 are described and shown in FIGS. 3 and 4, within the annularly extending wall 110, it will be appreciated that the nozzles 114 may be located within any location along the first flow path so as to reduce the flow rate therethrough. It will also be appreciated that other devices may be utilized to reduce the flow rate through the first path 120, such as, by way of non-limiting examples, restricted openings, slots, valves or the like.

FIG. 4 best illustrates the annular cavity 46. Proximate to the first end 26 of the valve body 24, the first end retaining sleeve 44 internal diameter is sized to fit the external diameter of the first end connector 32, and the external diameter of the first end retaining sleeve 44 is sized to fit and match the external diameter of the outer casing 42 such that the first end of the annular cavity 46 is sealed from the exterior of the valve body 24. Proximate to the second end 28 of the valve body 24, the external diameter of the central portion 70 of the second end valve body 38 is sized to fit the internal diameter of the outer casing 42, as described above. Optionally the annular cavity 46 may contain a fluid which is to be delivered to the production section 16 once one of the valve bodies is opened.

During installation of the valve body 24 into a wellbore 10, the second end retaining sleeve 45 sealably covers the apertures 72 of the second end valve body 38, as illustrated in FIG. 2, so as to prevent contamination from entering therein. To operate, following installation, the valve body 24 may be pressurized to fracture the second end retaining sleeve 45, as is commonly known, such that the second end retaining sleeve 45 is perforated or destroyed, and no longer covers the apertures 72. It may be appreciated that chemicals or other dissolving chemicals may be used to perforate the second end retaining sleeve 45, as is commonly known. The valve body 24 may then be used in three distinct positions. The first retracted position is illustrated in FIG. 4. In this position, both the first and second end valve bodies 34 and 38 are closed, with the first and second valve body sleeves 64 and 74 sealably covering the apertures 62 and 72. In this position, fluid passes through the central passage 30 of the valve body 24, and does not connect to the annular cavity 46 or the production section 16.

The second extended position of the valve body 24 is illustrated in FIG. 6. In this position, the first end valve body 34 is in the first retracted position, as illustrated in FIG. 4, while the second end valve body 38 is in the second extended position, with the second end sleeve 74 extended to expose the apertures 72 such that the fluid from the central passage 30 is fluidically connected to the production section 16 through the second flow path 122. A shifting key, as is commonly known, is used to extend the second end sleeve 74. When the apertures 72 are exposed as illustrated in FIG. 6, a large volume of fluid may pass through the apertures 72 to the production section 16. This position may be used for fracing or high volume stimulation flow rates.

The third extended position of the valve body 24 is illustrated in FIG. 7. In this position, the first end sleeve 64 is extended to expose the apertures 62, while the second end valve body 24 is in the first retracted position, as illustrated in FIG. 4, with the second sleeve 74 sealably covering the apertures 72. A shifting key, as is commonly known, is used to extend the first end sleeve 64.

When the apertures 62 are exposed as illustrated in FIG. 7, a volume of fluid controllable by the nozzles 114 may pass through the apertures 62 from the central passage 30 to the annular cavity 46, through the nozzles 114 and the slots 86 to the production section 16 through the first flow path 120. This position may be used for low volume stimulation flow rates or production.

As set out above, it is observed that a user may select either of the first or second flow paths 120 or 122 to deliver fluid flow and entrained materials to the production section 16. Advantageously, each of the first and second flow paths terminate and enter the production section at the same location. This common location will permit both a cementing and completion using the same port location thereby preventing cement from covering or otherwise obstructing the nozzle ports.

While specific embodiments of the invention have been described and illustrated, such embodiments should be considered illustrative of the invention only and not as limiting the invention as construed in accordance with the accompanying claims.

What is claimed is:

1. An apparatus for selectably injecting materials into a well comprising:

an elongate inner casing having a first set of passages selectably closable by a first sleeve and a second set of passages selectably closable by a second sleeve therethrough; and an outer casing extending between first and second ends surrounding said inner casing so as to form an annular cavity therebetween, wherein said first end of said outer casing is sealably connected to said inner casing, wherein said second end of said outer casing has a free edge proximate to said second set of passages;

wherein said first set of passages extends through said inner casing into said annular cavity such that fluid passing through either of said first or second sets of passages enters an exterior of said apparatus at a common location, wherein the first and second sleeves are located within the central passage and freely engagable by a shifting tool.

2. The apparatus of claim 1 wherein said first and second passages provide first and second paths from an interior of said inner casing to the exterior of said apparatus.

3. The apparatus of claim 2 wherein said first and second paths have different flow rates therethrough.

4. The apparatus of claim 3 wherein said first path has a lower flow rate than said second path.

5. The apparatus of claim 4 wherein said first path includes at least one nozzle therein selected to reduce the flow rate through said first path to a desired rate.

6. The apparatus of claim 5 wherein said at least one nozzle is located within said annular cavity.

7. The apparatus of claim 6 wherein said nozzles are located within a nozzle body.

8. The apparatus of claim 7 wherein said nozzle body are secured within an annular wall extending between the inner and outer casings within the cavity.

9. The apparatus of claim 8 wherein said nozzles are threadably inserted within ports in the annular wall.

10. The apparatus of claim 5 wherein said at least one nozzle is located with said first set of passages.

11. The apparatus of claim 5 wherein said at least one nozzle may comprise a plurality of nozzles.

12. The apparatus of claim 1 wherein said first and second sleeves are longitudinally moveable within an interior of said casing to selectably cover or uncover said first and second ports.

13. The apparatus of claim 1 wherein said interior casing includes an enlarged portion around said second set of passages so as to radially support said second end of said outer casing.

14. The apparatus of claim 13 wherein said enlarged portion includes a plurality of longitudinal slots formed into an exterior surface thereof.

15. The apparatus of claim 14 wherein said longitudinal slots are spaced at locations corresponding to each passage of said second set of passages.

16. The apparatus of claim 14 wherein said longitudinal slots extend into and are in fluidic communication with said annular passage.

17. The apparatus of claim 16 further comprising a frangible band secured around said enlarged portion so as to cover said second set of passages and said slots in an initial position.

18. A method of selectably injecting materials into a well comprising:

securing an elongate inner casing having first and second sets of selectably closable passages therethrough with a corresponding outer casing surrounding said inner casing so as to form an annular cavity therebetween to a wellbore string;

positioning said inner casing at a desired position within the wellbore; and selectably opening or closing one of said first or second passages with a corresponding first or second sleeve, with the use of a shifting tool freely engageable on the first or second sleeve from within central passage, to provide a first or second path from an interior of said inner casing to an exterior of said inner and outer casings;

wherein said first path extends through said annular cavity and said second path extends through said second set of passages and wherein said first and second passages terminate at a common location.

19. The method of claim 18 further comprising rupturing a frangible band covering a termination of said first and second paths when either of said first or second sets of passages is opened to flow of fluid from within said interior of said inner casing.

20. The method of claim 18 further comprising providing at least one nozzle to throttle a flow rate through said first path.

* * * * *